US007527392B2

(12) United States Patent
Kovacik et al.

(10) Patent No.: US 7,527,392 B2
(45) Date of Patent: May 5, 2009

(54) RECHARGEABLE FLUORESCENT UTILITY LIGHT

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co., Inc., Bedford Heights, OH (US)

( * ) Notice: Subject to any disclaimer, the term of this patent is extended or adjusted under 35 U.S.C. 154(b) by 403 days.

(21) Appl. No.: 11/357,556

(22) Filed: Feb. 17, 2006

(65) Prior Publication Data

US 2006/0139927 A1 Jun. 29, 2006

Related U.S. Application Data

(63) Continuation-in-part of application No. 10/898,856, filed on Jul. 26, 2004, now Pat. No. 7,090,381, which is a continuation-in-part of application No. 29/206,355, filed on May 28, 2004, now Pat. No. Des. 501,687, and a continuation-in-part of application No. 29/206,356, filed on May 28, 2004, now Pat. No. Des. 501,688.

(51) Int. Cl.
*F21V 23/02* (2006.01)
*F21L 4/00* (2006.01)

(52) U.S. Cl. ..... 362/260; 362/183

(58) Field of Classification Search ..... 362/183, 362/260

See application file for complete search history.

(56) References Cited

U.S. PATENT DOCUMENTS

D235,573 S 6/1975 Brych
4,262,327 A 4/1981 Kovacik et al.
4,432,043 A 2/1984 Yuen
4,442,984 A 4/1984 Bayat
4,774,647 A 9/1988 Kovacik
4,958,267 A 9/1990 Baake
5,023,764 A 6/1991 McKinnon et al.
5,115,382 A 5/1992 Smith (Continued)

FOREIGN PATENT DOCUMENTS

DE 198 02 998 8/1998

(Continued)

OTHER PUBLICATIONS

Ferret Worklite AC, Jun. 4, 2002, www.ferretinstruments.com.

(Continued)

*Primary Examiner*—Sandra O'Shea
*Assistant Examiner*—James W Cranson
(74) *Attorney, Agent, or Firm*—Fraser Clemens Martin & Miller LLC; William J. Clemens

(57) ABSTRACT

A utility light has a dual fluorescent lamp assembly mounted in a housing with a removable lens for ease of lamp replacement. The lens is releasably retained at an upper end by a locking tab. The housing has a swivel hook, a handle cushion, a housing cushion at the upper end, and a bottom cushion at a lower end. The lamp assembly is powered by a battery pack assembly releasably mounted in a handle portion of the housing for removal and insertion into a charging stand.

20 Claims, 14 Drawing Sheets

U.S. PATENT DOCUMENTS

| | | | | |
|---|---|---|---|---|
| 5,243,505 | A | 9/1993 | Carr | |
| 5,301,093 | A | 4/1994 | Baggio | |
| D348,249 | S | 6/1994 | Hester | |
| 5,465,196 | A | 11/1995 | Hasenberg et al. | |
| D367,123 | S | 2/1996 | Blye | |
| 5,528,477 | A | 6/1996 | Carmo | |
| 5,700,089 | A | 12/1997 | McKinnon | |
| D389,931 | S | 1/1998 | Kovacik et al. | |
| 5,765,941 | A | 6/1998 | Vest | |
| 5,818,234 | A | 10/1998 | McKinnon | |
| D409,776 | S | 5/1999 | Ghode et al. | |
| 5,921,658 | A | 7/1999 | Kovacik et al. | |
| 5,975,719 | A | 11/1999 | Reiff et al. | |
| 5,988,828 | A * | 11/1999 | Prince et al. | 362/191 |
| D418,238 | S | 12/1999 | Offiler | |
| D421,142 | S | 2/2000 | Bayat | |
| D421,143 | S | 2/2000 | Kovacik et al. | |
| 6,123,434 | A * | 9/2000 | Meltzer | 362/260 |
| 6,132,071 | A | 10/2000 | Yuen | |
| 6,169,373 | B1 | 1/2001 | Riesinger | |
| D439,354 | S | 3/2001 | Yuen | |
| 6,260,442 | B1 | 7/2001 | Bayat | |
| 6,367,949 | B1 | 4/2002 | Pederson | |
| 6,386,736 | B1 | 5/2002 | Reiff et al. | |
| D458,400 | S | 6/2002 | Kovacik et al. | |
| 6,505,952 | B1 * | 1/2003 | Kish et al. | 362/197 |
| 6,534,926 | B1 | 3/2003 | Miller et al. | |
| D483,508 | S | 12/2003 | Galvez | |
| D483,893 | S | 12/2003 | Galvez | |
| D484,628 | S | 12/2003 | Bayat et al. | |
| 6,663,265 | B2 | 12/2003 | Kovacik et al. | |
| D486,599 | S | 2/2004 | Bayat et al. | |
| 6,722,774 | B2 | 4/2004 | Kovacik et al. | |
| 2002/0191396 | A1 | 12/2002 | Reiff et al. | |
| 2003/0039121 | A1 | 2/2003 | Nezigane | |
| 2003/0123254 | A1 | 7/2003 | Brass et al. | |
| 2003/0179572 | A1 | 9/2003 | Schnell | |

FOREIGN PATENT DOCUMENTS

| | | |
|---|---|---|
| DE | 203 17 017 | 2/2004 |
| WO | WO02/03761 | 1/2002 |

OTHER PUBLICATIONS

Bayco SL-2105, Bayco SL-2106, Apr. 1, 2003, www.budgetlighting.com.

Derwent No. 1986-202803, Lock et al., Current passage monitor for electrical conductor—uses DC voltage drop measurement at two separate points to activate LED which indicates current is reaching equipment, e.g. lamp.

* cited by examiner

RECHARGEABLE FLUORESCENT UTILITY LIGHT

CROSS-REFERENCE TO RELATED APPLICATIONS

This application is a continuation-in-part of the utility application Ser. No. 10/898,856 filed on Jul. 26, 2004 now U.S. Pat. No. 7,090,381, which is a continuation-in-part of the U.S. design patent application Ser. No. 29/206,355, filed on May 28, 2004, now U.S. Pat. No. D501,687, and U.S. design patent application Ser. No. 29/206,356, filed on May 28, 2004, now U.S. Pat. No. D501,688.

BACKGROUND OF THE INVENTION

The present invention relates generally to illumination devices and, in particular, to a fluorescent utility light.

Portable lights, which can be manually moved and suspended about a work site to aid a user to obtain the best lighting conditions, are well known. It has been the practice to use incandescent light bulbs, suitably encased in light guards, for this purpose. Such lights are often referred to as trouble lamps, extension lights, work lights, inspection lights, utility lights, and the like, and are commonly employed by mechanics and other workers who require a concentration of light while frequently changing locations. Such a trouble light is shown in the U.S. Pat. No. 4,774,647 to Kovacik et al.

Fluorescent lights have several advantages in use as compared with the incandescent bulbs. As an example, for the same wattage fluorescent lights usually provide more light with less glare. In the past, attempts have been made to convert portable lights such as extension lights to fluorescent tubes. However, a number of problems have arisen, particularly in attempting to adapt a fluorescent tube to a satisfactory portable assembly, including electrical contact problems with the tubes, and problems arising when the tubes need replacement.

The U.S. Pat. No. 4,262,327 shows a portable fluorescent tube having a lens and a hook for hanging the assembly. The assembly includes a tubular envelope surrounding a standard fluorescent tube and closed by a pair of end sockets. One of the end sockets has a starter switch mounted thereon and a ballast is connected in an electrical supply line near an electrical plug. However, in order to change the fluorescent tube, such a light assembly must be disassembled.

Many prior art portable fluorescent tube assemblies require the use of tools to disassemble the light assembly in order to replace the fluorescent tubes. Portable light assemblies are also notoriously and disadvantageously susceptible to tube breakage, primarily because portable light assemblies are much more likely to be handled roughly, dropped or, at a minimum, subject to jarring, vibration, and the like. Those skilled in the art will also realize that because of the frequently changing location of the utility light, finding a location for hanging and correctly orienting the light is often difficult. Those skilled in the art will also realize that it is often desirable to provide a concentration of light at a work site.

The art continues to seek improvements. It is desirable to provide a portable light assembly that that may be disassembled and assembled by hand to replace the fluorescent tubes. It is also desirable to provide a utility light that is resistant to tube breakage. It is desirable to provide a portable light with multiple suspension options in order to be able to place and orient the portable light in as many locations and positions as possible. It is also desirable to provide a spotlight for providing concentrated illumination. It is also desirable to provide a portable light with a rechargeable battery pack such that an electrical cord extending from the light is not necessary. It is always desirable to provide utility lamps that are lightweight and cost-effective to produce.

SUMMARY OF THE INVENTION

The present invention concerns a utility light comprising: a light housing having an upper light portion and a lower handle portion, the upper light portion having a lens opening; a removable lens assembly closing the lens opening and having a receiver; and a locking means cooperating with the light housing and the lens assembly and including a locking tab being slidably movable between a locked position engaging the receiver and preventing removal of the lens assembly from the lens opening and an unlocked position permitting removal of the lens assembly from the lens opening.

The present invention also concerns a utility light comprising: a light housing having an upper light portion and a lower handle portion, the upper light portion having a lens opening with a first groove extending along each of a pair of opposed edges of the upper light portion at the lens opening, the first groove being formed between a pair of first flanges; and a lens assembly sized to close the lens opening, the lens assembly having a second groove extending along each of a pair of opposed edges thereof, the second groove being formed between a pair of second flanges whereby at each side of the light housing one of the first flanges releasably engages with a corresponding one of the second grooves and one of the second flanges releasably engages with a corresponding one of the first grooves to position the lens assembly in the lens opening.

In a further embodiment, the present invention concerns a utility light comprising: a light housing having an upper light portion and a lower handle portion, the upper light portion having a lens opening; a lens assembly sized to close the lens opening and being releasably attached to the light housing; a fluorescent lamp assembly mounted in the light portion adjacent the lens assembly; and a spotlight assembly mounted in an upper end of the light portion for directing light in a different direction than light from the fluorescent lamp assembly.

The present invention also concerns a utility light comprising: a light housing having an upper light portion and a lower handle portion, the upper light portion having a lens opening; a lens assembly sized to close the lens opening and being releasably attached to the light housing; a fluorescent lamp assembly mounted in the light portion adjacent the lens assembly; a halogen spotlight assembly mounted in an upper end of the light portion for directing light in a different direction than light from the fluorescent lamp assembly; and a switch means connected to the halogen spotlight assembly and to the fluorescent lamp assembly for independently connecting the halogen spotlight assembly and the fluorescent lamp assembly to a source of electrical power.

The present invention also concerns a utility light having a removable battery pack assembly that advantageously does not require the use of an electrical cord extending from the light housing.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
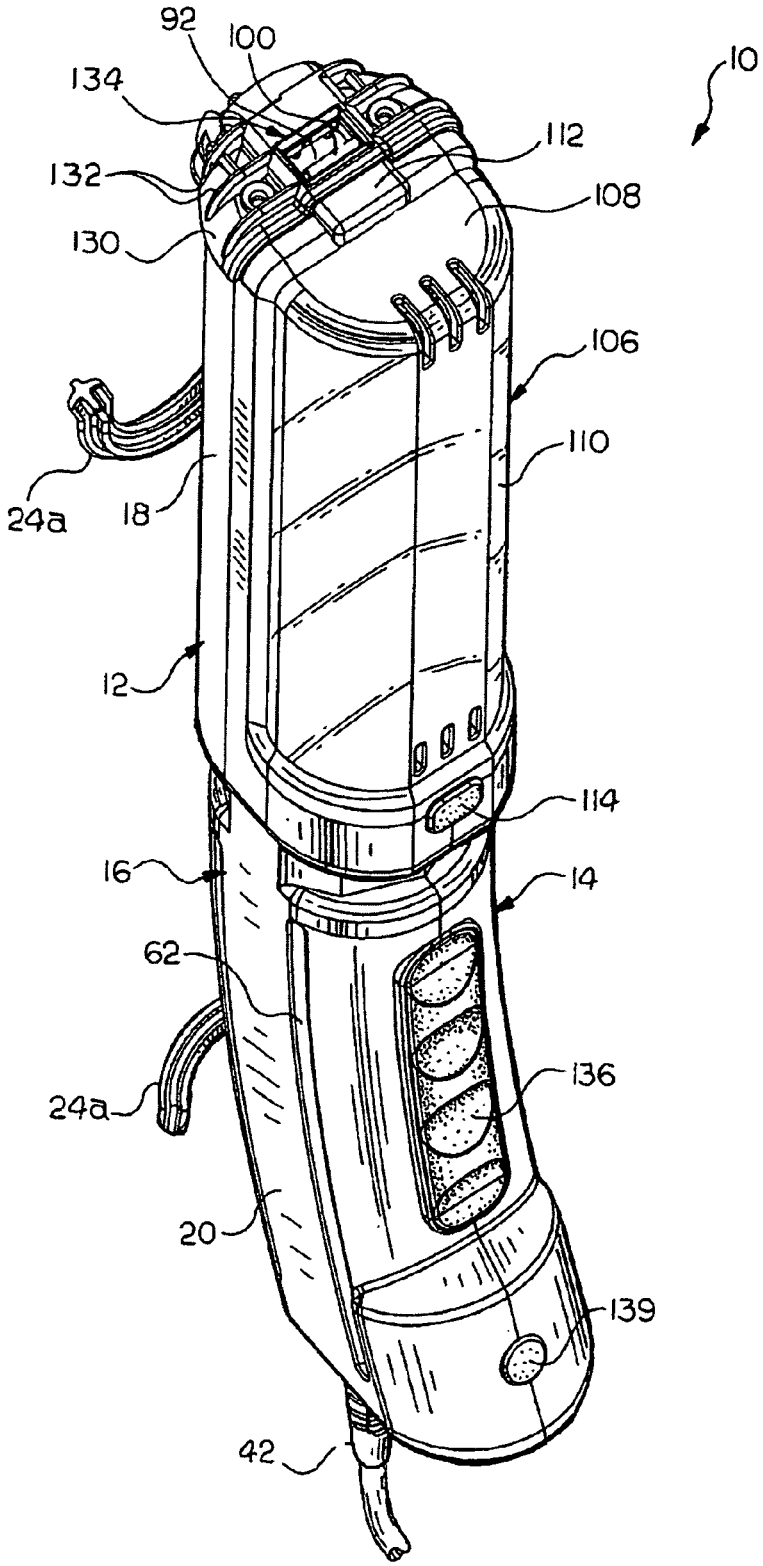
FIGS. 1A and 1B are perspective front and rear views respectively of a fluorescent utility light in accordance with the present invention.

Referring now to FIGS. 1A, 1B and 2-5, a fluorescent utility light is indicated generally at 10. The utility light 10 includes a vertically split hollow light housing 12 formed in two housing halves 14 and 16 with an elongated upper light portion 18 extending from a hollow lower handle portion 20. The handle portion 20 is preferably ergonomically curved to allow the utility light 10 to be easily manipulated during use. The housing 12 is preferably formed of a lightweight material, such as plastic, as the utility light 10 is contemplated to be both handheld and portable.

Figure 1B:
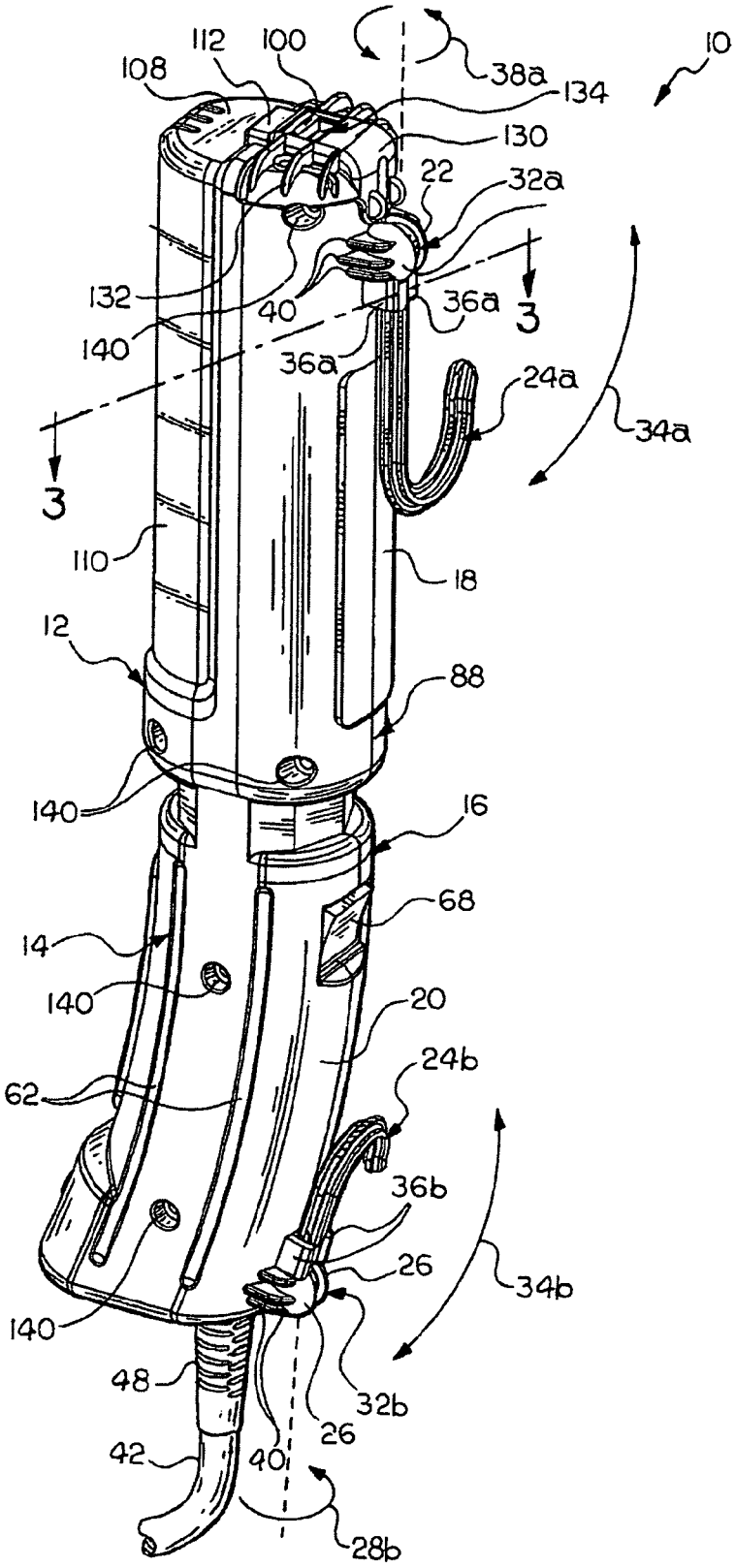

Each half 14 and 16 of the split housing 12 includes an outwardly extending half upper socket 22 for receiving an upper hook 24*a* and an outwardly extending half lower socket 26 for receiving a lower hook 24*b*. The upper hook 24*a* and the lower hook 24*b* are substantially identical and include ball portions 28*a* and 28*b* respectively that are connected to shank portions 30*a* and 30*b* respectively. The ball portions 28*a* and 28*b* are retained between the halves of the respective sockets 22 and 26, forming a pair of ball and socket connections. When the halves 14 and 16 of the split housing 12 are joined, recesses formed in facing surfaces of the halves of the sockets 22 and 26 receive the ball portions 28*a* and 28*b* respectively. The facing surfaces of the halves of the sockets 22 and 26 are spaced apart to define channels 32*a* and 32*b* therebetween that function as a guide for the shank portions 30*a* and 30*b* respectively to allow the hooks 24*a* and 24*b* to pivot only in a generally vertical plane as shown by arrows 34*a* and 34*b*. Two pairs of walls 36*a* and 36*b* extend outwardly from a rear surface of each of the halves 14 and 16 of the housing 12 with each wall 36*a* and 36*b* adjacent one of the sockets 22 and 24 to function as storage supports on either side of the shank portions 30*a* and 30*b* of the hook members 24*a* and 24*b*. The hook members 24*a* and 24*b*, once moved beyond the walls 36*a* and 36*b*, are free to rotate as shown in FIG. 1B by arrows 38*a* and 38*b*. A plurality of transverse strengthening ribs 40 extend between the exterior surfaces of each of the sockets 22 and 26 and the exterior surface of the housing 12. The hooks can be the same size, or different sizes as shown by the upper hook 24*a* being of a larger size than the lower hook 24*b*.

Figure 2:
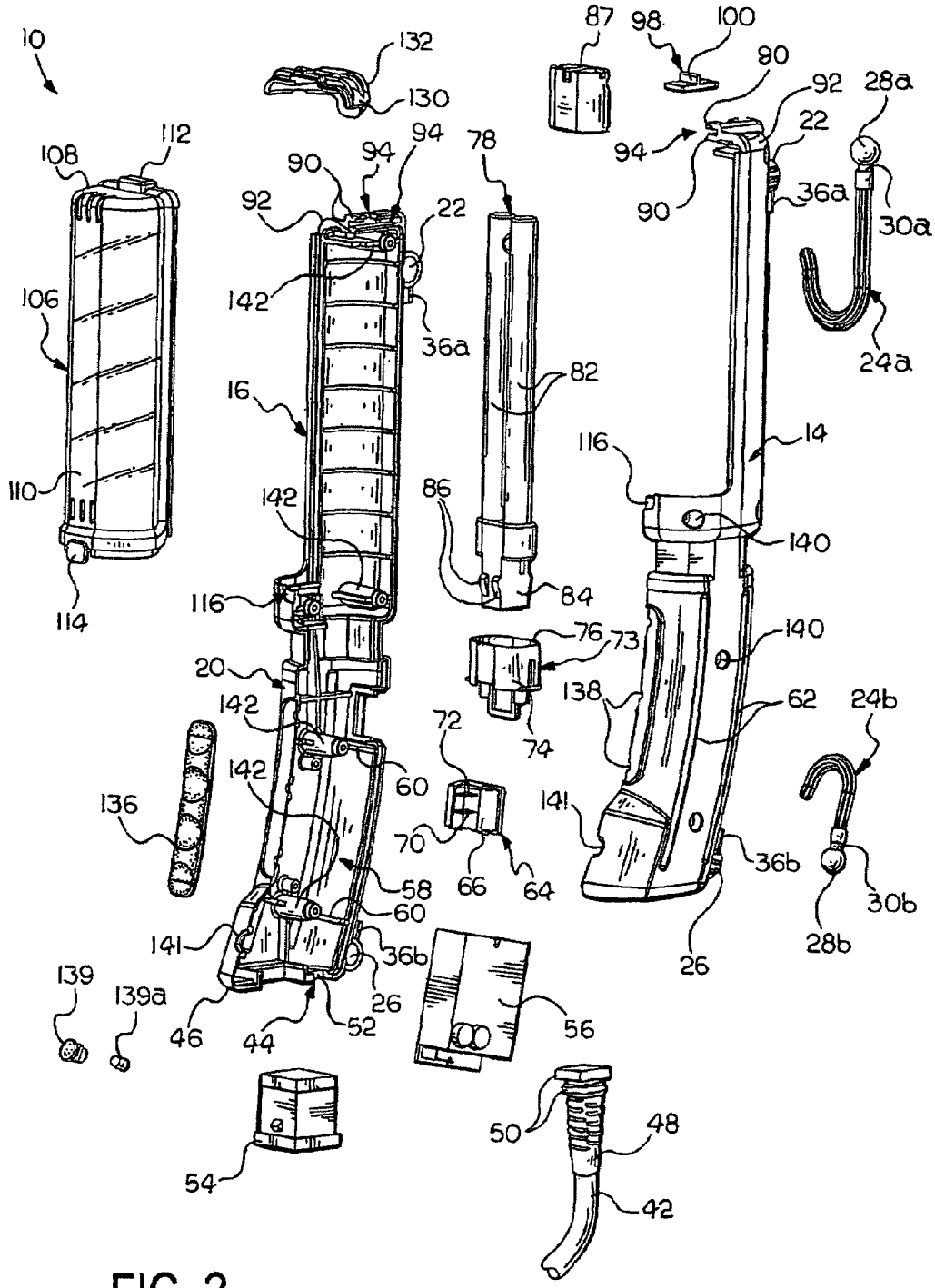
FIG. 2 is an exploded perspective view of the utility light shown in FIGS. 1A and 1B.

A power cord 42 extends through an aperture 44, best seen in FIG. 2, in a bottom surface 46 of the handle portion 20 and is used to provide power to the circuitry, discussed below, that is enclosed within the handle portion 20. A strain relief means 48, best seen in FIG. 2, is attached to the power cord 42. At an upper end of the strain relief means 48 there are formed two spaced apart circumferential flanges 50 that cooperate with an edge 52 of the bottom surface 46 forming the aperture 44 to retain the power cord 42 in place. Should a force be applied to the power cord 42 tending to pull it from the bottom surface 46, the flanges 50 absorb the force so that the electrical connections between the cord and the circuitry in the handle 20 may be maintained. The free end of the power cord 42 has a male plug (not shown) for insertion into a common female electrical power receptacle. An integral electrical outlet 54 is provided in another aperture in the bottom surface 46. The outlet 54 is preferably a standard female three-prong grounded electrical outlet and is electrically connected (not shown) to the power cord 42 so that the outlet 54 is energized when the power cord 42 is energized. The outlet 54 can be utilized, for example, to receive an electrical plug at the end of a power cord for an electrically powered tool (not shown) or another light fixture (not shown).

A circuit board assembly 56 is received in an interior recess 58 in the hollow handle portion 20. The recess 58 is bounded by a plurality of ribs 60 that aid in both aligning the circuit board assembly 56 in the handle portion 20 and in preventing movement of the circuit board assembly 56 once mounted in the recess 58 and after the housing halves 14 and 16 are joined. The circuit board assembly 56 includes a ballast for the utility light 10. A plurality of slots 62 are formed in a side wall of each half of the handle portion 20 to provide air circulation and remove heat generated by the circuit board assembly 56. The circuit board assembly 56 is electrically connected to the power cord 42. The circuit board assembly 56 provides power to the remainder of the electrical circuitry enclosed within the handle portion 20.

A single switch 64 includes a switch housing 66 with a switch rocker 68 having a first electrical terminal 70 and a second electrical terminal 72 extending downwardly from a bottom surface of the housing 66. The electrical terminal 70 of the switch 64 is electrically connected to the circuit board assembly 56, while the second electrical terminal 72 of the switch 64 is electrically connected to an electrical terminal of a lamp socket 73. The switch 64 is easily actuated by a thumb or finger of a person (not shown) holding the handle portion 20 to light a lamp assembly 78 with one hand while also orienting and/or hanging the light 10 with the same hand.

The lamp socket 73 is preferably a commercially available socket and includes a socket housing 74 having a socket 76 formed therein for receiving the fluorescent lamp assembly 78. The electrical terminals that extend downwardly from a bottom surface of the socket housing 74 from the socket 76 are electrically connected to the second electrical terminal 72 of the switch 64, forming an electrical circuit. The socket housing 74 is received in a cavity 80 at an upper end of the handle portion 20.

The socket 76 receives the lamp assembly 78 that includes twin fluorescent bulbs 82 that are mounted in a base 84 having a plurality of electrical contacts 86 that cooperate with interior electrical contacts (not shown) in the socket 76. The base 84 includes internal electrical contacts (not shown) for the bulbs 82. If a bulb 82 fails, the lamp assembly 78 is replaced as an assembly; the individual bulbs 82 are not replaced. When the switch 64 is activated, power is sent to the socket 76 and thus to the lamp assembly 78, the lamp assembly 78, the socket 73, and the switch 64 forming a separate electrical circuit. A reflector (not shown) for directing the illumination towards a work area (not shown) and away from the light portion 18 may be attached on a posterior side of the lamp assembly 78, and cooperates with notches (not shown) on an interior surface of the light portion 18. A bulb cushion 87 includes apertures (not shown) formed therein to receive respective free upper ends of the fluorescent bulbs 82 for protecting the bulbs 82 from breakage during use of the utility light 10. The bulb cushion 87 is preferably constructed of a deformable, resilient shock absorbing material.

The upper light portion 18 of the light housing 12 is generally oval in cross-section and the halves of the upper light portion 18 are joined at a seam 88 (FIG. 1B) on the rear surface of the housing 12. Each half of the light portion 18 is open at a front side of the light to form a lens opening for receiving the lamp assembly 78 and the reflector during assembly. A pair of facing flanges 90 extends inwardly from a top surface 92 of each of the housing halves 14 and 16 to define a recess 94 therebetween. An upper one of the flanges 90 includes an aperture 96 formed therein. A locking tab 98 is adapted to be received in the recess 94 during assembly of the utility light 10. The locking tab includes a finger 100 extending from an upper surface thereof and a split center portion 102 extending between a pair of engaging arms 104 on a free end thereof, best seen in FIG. 4. A lens assembly 106 includes an upper surface 108 and a body portion 110 that is generally arcuate in cross-section and extends downwardly from the upper surface 108. The upper surface 108 includes a receiver 112 formed therein. The body portion 110 includes a tongue 114 extending downwardly from a lower edge thereof.

To attach the lens assembly 106 to the light portion 18, the lower end of the lens assembly 106 is placed in the light portion 18 opening with the tongue 114 inserted into a groove 116 formed at a lower edge of the front side of the housing 12 and a surface 112*a* of the receiver 112 is aligned with an outward facing surface 90*a* of each of the flanges 90. Prior to the lens assembly 106 being placed adjacent the light portion, the locking tab 98 is moved away from the surfaces 90*a* and into a portion 94*a* of the recess 94, best seen in FIG. 4, which causes a projection 104*a* on a free end of each of the engaging arms 104 to engage with the a corresponding surface 90*b* of the flange 90. This engagement between the projections 104*a* and the surfaces 90*b* causes the engaging arms 104 to flex toward the split center portion 102. After the lens assembly 106 is placed in the light portion 18, the locking tab 98 is moved towards the surfaces 90*a*. When moved in this direction, a forward portion 98*a* of the locking tab 98 extends into a recess 112*b* formed in the receiver 112 in a substantially interference fit. In addition, the projections 104*a* of the engaging arms 104, when the locking tab 98 is moved forward, flex outwardly to engage with a stop recess 90*c* formed in the each of the opposing surfaces 94*b*, which acts as a stop for the locking tab 98. The substantial interference fit of the forward portion 98*a* of the locking tab 98 and the engagement of the projections 104*a* and the stop recesses 90*c*, firmly and releasably engages the lens assembly 106 with the light portion 18. Movement of the locking tab 98 in the opposite direction advantageously allows the lens assembly 106 to be removed from the light portion 18 by hand without the use of tools when replacing the lamp assembly 78. Movement of the locking tab 98 is facilitated by the finger 100 that can be engaged by a human hand.

Figure 3:
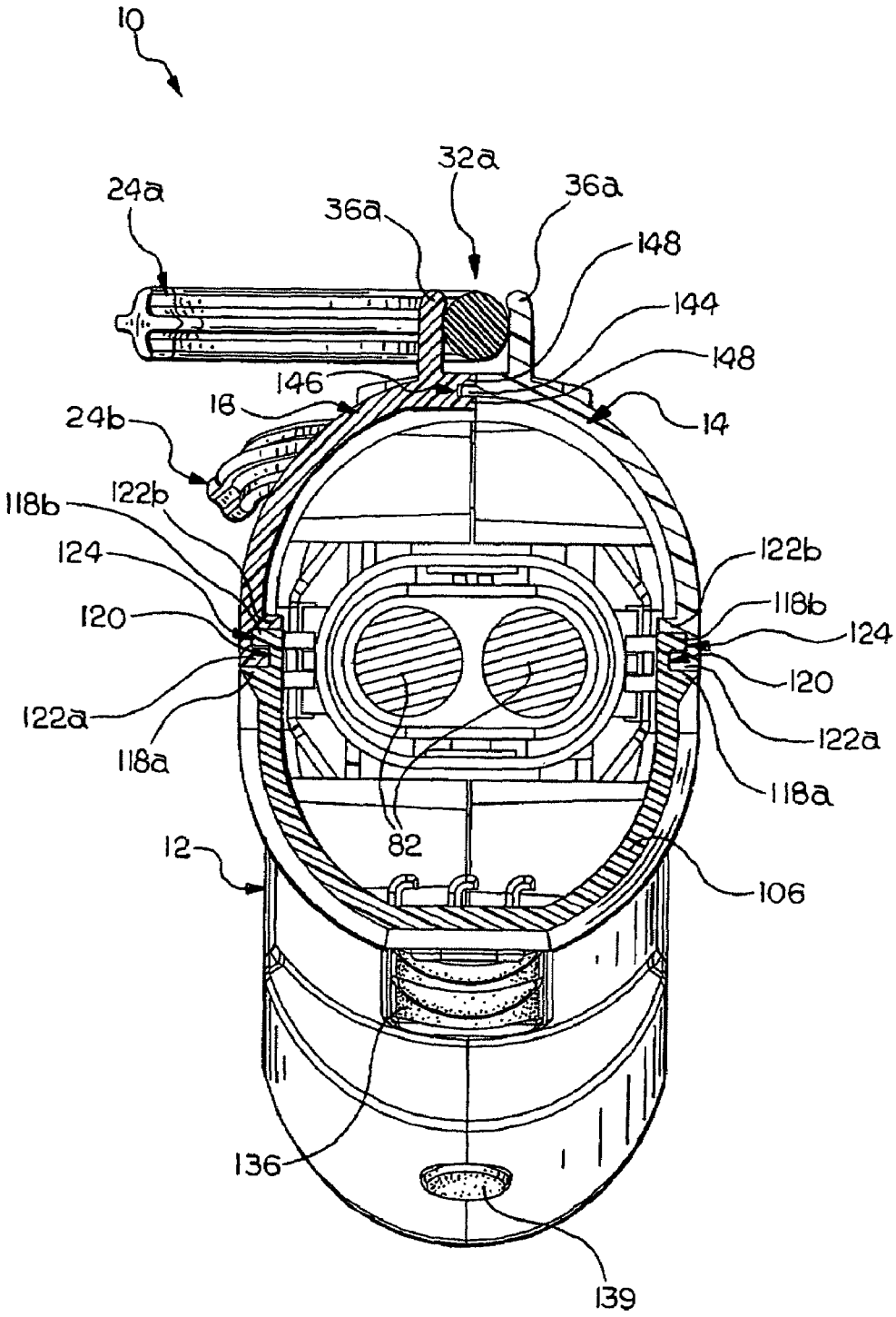
FIG. 3 is a cross-sectional view taken along line 3-3 in FIG. 1B.

As best shown in FIG. 3, two longitudinally extending flanges 118*a* and 118*b* are formed at each opposed side edge of the lens assembly 106 and define a groove 120 therebetween. Two longitudinally extending flanges 122*a* and 122*b* are formed at each opposed side of the housing halves 14 and 16 and define a groove 124 therebetween. When the lens assembly 106 is attached to the light portion 18, each flange 118*b* is disposed in the corresponding groove 124 and each flange 122*a* is disposed in the corresponding groove 120, which seals the mating edges of the lens assembly 106 and the light portion 18. The interlocking flanges 118*a*, 118*b*, 122*a*, and 122*b* advantageously provide a robust connection between the lens assembly 106 and the light portion 18. The flanges can be released from the grooves by inwardly flexing the opposed sides of the lens assembly 106.

A housing cushion 130 is received by the top surface 92 of the assembled light portion 16. The housing cushion 130 includes a plurality of external fins 132 and absorbs shock forces encountered during use of the utility lamp 10. The housing cushion 130 is preferably press fit over the top portion 92. The housing cushion 120 is preferably constructed of a deformable, resilient shock absorbing material. A central aperture or opening 134 is formed in the cushion 130 for access to the locking tab 98.

An elongated handle cushion 136 includes a plurality of projections (not shown) that are received in corresponding gaps 138 formed in a front surface of the light housing 12 between the halves 14 and 16 of the handle portion 20. The handle cushion 136 is preferably constructed of a soft, easily deflectable material. A power indicator LED 139 having an electrical contact 139*a* is received in an aperture 141 formed in the front surface of the light housing 12 between the halves 14 and 16 of the handle portion 20. The LED 139 is electrically connected to the power cord 42 and emits a light when energized, providing a visual indication of the status of the outlet 54 and the utility light 10 to the user of the light 10.

The split halves 14 and 16 of the light housing 12 are joined by a plurality of fasteners such as screws (not shown) to complete the assembly of the halves of the housing 12. The screws are received in apertures 140 formed in the half 14 of the housing 12, and fastened to corresponding tapped cylindrical posts 142 formed in an interior wall in the half 16 of the housing 12. When the split halves 14 and 16 are joined, a tongue 144 extending from a rear edge of the housing half 14 cooperates with a groove 146 formed between a pair of flanges 148 extending from a rear edge of the housing half 16, best seen in FIG. 3, to provide ease of alignment of the split halves 14 and 16 during assembly of the light housing 12.

After the utility light 10 has been assembled with the screws, it is ready for use. To replace the lamp assembly 78, one must simply remove the housing cushion 130, detach the lens assembly 106 by moving the locking tab 98 into the portion 94*a* of the recess 94, remove the lamp cushion 87, and remove the lamp assembly 78 from the socket 73. After a new lamp assembly 78 has been inserted in the socket 73, the above steps are reversed. All of the above steps may be advantageously performed by hand, without the use of tools. Moving the locking tab 98 into the portion 94*a* of the recess 94 allows the surface 112*a* of the receiver 112 to move away from the surface 90*a* of the flanges 90. Once the locking tab 98 is released, contacting opposed sides of the lens assembly 106 with a thumb and finger and flexing inwardly disengages the interlocking flanges 118*a*, 118*b*, 122*a*, and 122*b* advantageously and enables one to pull the lens assembly 106 away from the lens opening in the light portion 18.

Figure 5:
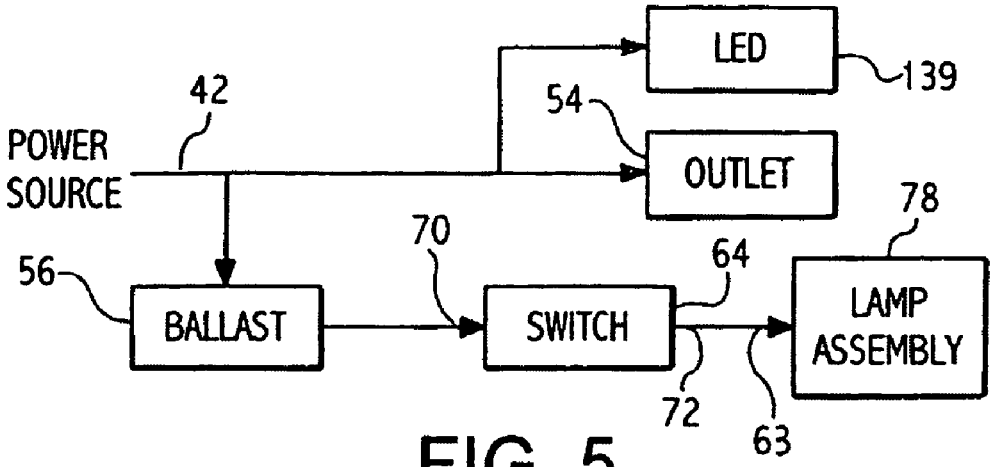
FIG. 5 is an electrical schematic for the utility light components shown in FIG. 2.

An electrical schematic of the utility light 10 is shown in FIG. 5. The cord 42 is provided for connection to an external power source which connection will render the outlet 54 and the LED 139 "live". The electrical power from the cord 42 is directed through the ballast 56 to the switch 64, which controls the turning "on" and "off" of the lamp assembly 78.

Referring now to FIGS. 6A, 6B and 7-10, an alternative embodiment of a fluorescent utility light according to the present invention is indicated generally at 10'. In this embodiment, similar elements are designated with the reference numerals previously used, while changed elements are designated with primed reference numerals.

The utility light 10' includes a vertically split hollow light housing 12' formed in two housing halves 14' and 16' with an elongated upper light portion 18' extending from a hollow lower handle portion 20'. The handle portion 20' is preferably ergonomically curved to allow the utility light 10' to be easily manipulated during use. The housing 12' is preferably formed of a lightweight material, such as plastic, as the utility light 10' is contemplated to be both handheld and portable.

Each half 14' and 16' of the split housing 12' includes the outwardly extending half upper socket 22 for receiving the upper hook 24*a* having the ball portion 28*a* and the shank portion 30*a* and the outwardly extending half lower socket 26 for receiving a lower hook 24*b* having the ball portion 28*b* and the shank portion 30*b*. The plurality of transverse strengthening ribs 40 extends between the sockets 18 and 22 and the housing 12'.

The utility light 10' includes the power cord 42 having the split member strain relief means 48 extending through the aperture 44 in the bottom surface 46 of the handle portion 20' for providing power to the circuitry, enclosed within the handle portion 20'. The end of the power cord 42 has a male plug (not shown) for insertion into a common female electrical power receptacle. The utility light 10' also includes the integral electrical outlet 54 that is electrically connected (not shown) to the power cord 42 so that the outlet 54 is energized when the power cord 42 is energized.

A double switch 64' includes a switch housing 66' with two switch rockers 68' each associated with a separate first electrical terminal 70' and a second electrical terminal 72' extending downwardly from a bottom surface of the housing 66'. A downwardly projecting planar divider 65 separates the terminals 70' and 72' of the switches. The first electrical terminal 70' of each switch is electrically connected to the circuit board assembly 56, while the second electrical terminal 72' of one of the switches is electrically connected to an electrical terminal of the lamp socket 73 and the second electrical terminal 72' of the other of the switches is electrically connected to a spotlight assembly 150, discussed in more detail below. The double switch 64' is easily actuated by a thumb or finger of a person (not shown) holding the handle portion 20' to light the lamp assembly 78 and/or the spotlight assembly 150 with one hand while also orienting and hanging the light 10' with the same hand. The lamp assembly 78 and the spotlight assembly 150 are positioned to direct light in different directions.

The lamp socket 73 includes the socket housing 74 having the socket 76 formed therein for receiving the fluorescent lamp assembly 78. The electrical terminals that extend downwardly from a bottom surface of the socket housing 74 from the socket 76 are electrically connected to the second electrical terminal 72' of one side of the switch 64' forming an electrical circuit. The socket housing 74 is received in the cavity 80 at an upper end of the handle portion 20'. The lamp assembly 78 includes the two fluorescent bulbs 82 that are received by the base 84 having the plurality of electrical contacts 86 that cooperate with interior electrical contacts (not shown) in the socket 76. The base 84 includes internal electrical contacts (not shown) for the bulbs 82. When the one side of the switch 64' for the lamp assembly 78 is activated, power is sent to the socket 76 and thus to the lamp assembly 78, the lamp assembly 78, the socket 73, and the one side of the switch 64' forming a separate electrical circuit. The utility light 10' may include a reflector (not shown) for directing the illumination towards a work area (not shown) and away from the light portion 18' may be attached on a posterior side of the lamp assembly 78, and cooperates with notches (not shown) on an interior surface of the light portion 18'. The bulb cushion 87 includes apertures (not shown) formed therein to received respective free ends of the fluorescent bulbs 82 for protecting the bulbs 82 from breakage during use of the utility light 10'. The bulb cushion 87 is preferably constructed of a deformable, resilient shock absorbing material.

The upper light portion 18' of the light housing 12' is generally oval in cross-section and the halves of the upper light portion 18 are joined at a seam 88' on the rear surface of the housing 12'. Each half of the light portion 18' is open at a front side for receiving the lamp assembly 78 and the reflector (not shown) during assembly. A facing flange 91 extends inwardly from an upper portion of each of the housing halves 14' and 16'. The flanges 91, when the halves 14' and 16' are attached, define an aperture 93 therebetween. A projection 152 extends outwardly from a rear edge of each of the halves 14' and 16' that defines an aperture 154 therebetween. A lens assembly 106' includes a body portion 110' that is generally arcuate in cross-section. The body portion 110' includes the tongue 114 extending downwardly from a lower edge thereof and a receiver 156 formed from an upper edge thereof. The receiver 156 defines an aperture 158 therein. The apertures 154 and 158 are preferably sized and/or threaded to receive a fastener, such as a screw or the like.

The spotlight assembly 150 includes a housing cap 160 that receives a stacked subassembly that includes a lamp socket 162, a lamp 164, a lamp seal 166, a lamp bezel 168, and a bumper member 170. The lamp 164 is preferably a halogen lamp. The housing cap 160 is substantially oval in cross section and includes a plurality of fins 172 formed on a peripheral wall 174 extending upwardly from an interior surface (not shown) thereof. The interior surface includes an electrical connector (not shown) for connecting electrical connectors of the lamp socket 162 and the other side of the double switch 64' for the spotlight assembly 150 through a plurality of wires 176, best seen in FIG. 8, routed through an interior of the light portion 18' of the housing 12'. When the other side of the switch 64' for the spotlight assembly 150 is activated, power is sent to the socket 162 and thus to the lamp 164, the lamp 164, the socket 162, and the switch 64' forming a separate electrical circuit. The lamp seal 166 is operable to seal opposing surfaces of the lamp 164 and the lamp bezel 168 to prevent foreign objects from harming the lamp 164. The bumper 170 includes a plurality of projections 171 extending therefrom to protect the bezel 168 from accidental breakage during use of the utility light 10'. The bumper 170 is preferably constructed of a deformable, resilient shock absorbing material.

Figure 8:
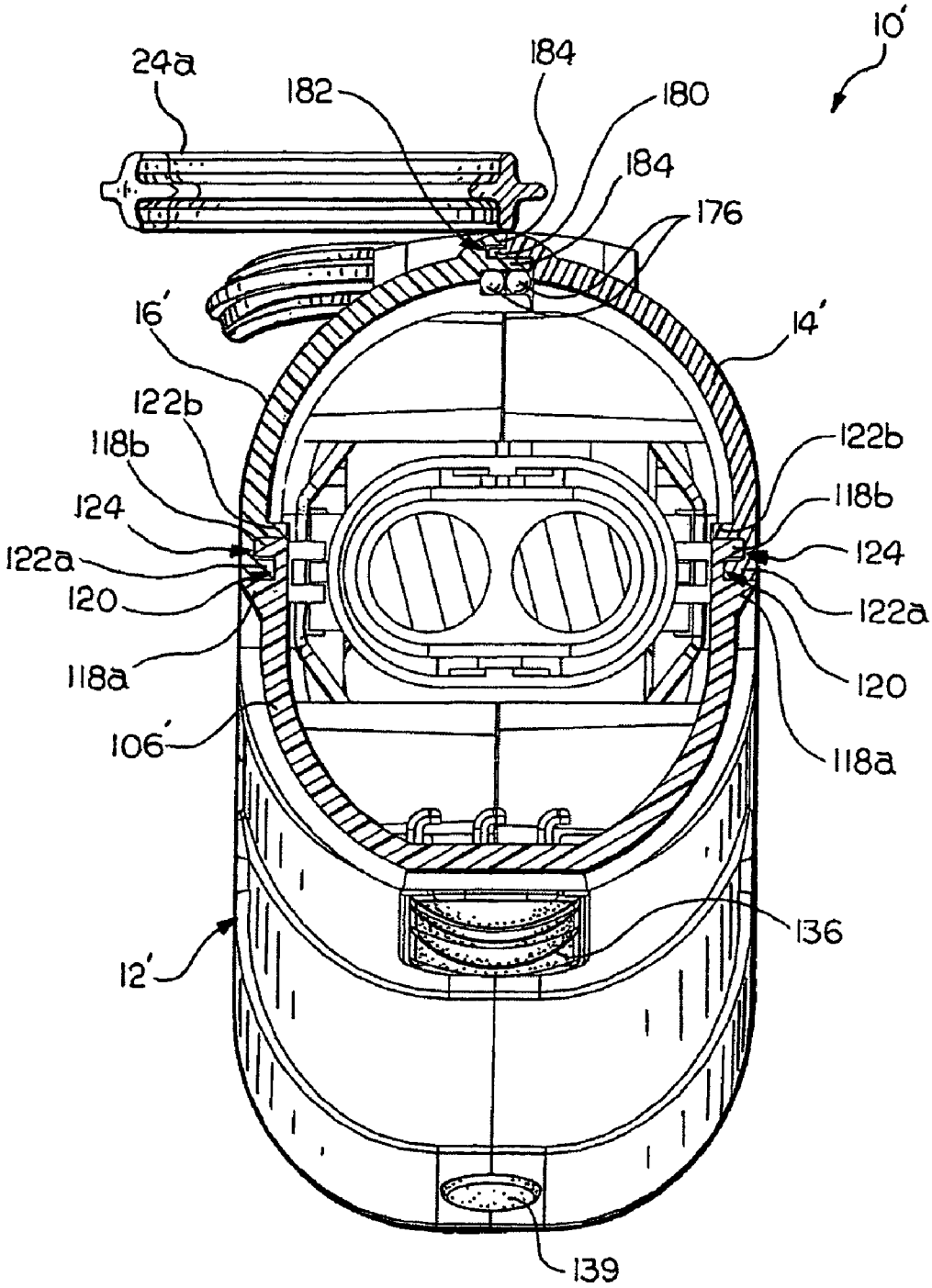
FIG. 8 is a cross-sectional view taken along line 8-8 in FIG. 6A.

To attach the lens assembly 106' to the light portion 18', the lower end of the lens assembly 106' is placed in the light portion 18' opening with the tongue 114 inserted into a groove 116 formed at a lower edge of the front side of the housing 12'. When the lens assembly 106' is attached to the light portion 18', the flange 118*b*, best seen in FIG. 8, is disposed in the groove 124 and the flange 122*a* is disposed in the groove 120, which seals the mating edges of the lens assembly 106' and the light portion 18'. The interlocking flanges 118*a*, 118*b*, 122*a*, and 122*b* advantageously provide a robust connection between the lens assembly 106' and the light portion 18'.

After the lens assembly 106' and the light portion 18' have been attached, the spotlight assembly 150 is attached to the lens assembly 106' and the light portion 18'. The electrical connector in the housing cap 160 is attached to a corresponding electrical connector at an upper edge of the light portion 18', forming the electrical circuit between the lamp 164, the socket 162, and the switch 64'. The housing cap 160 includes a fastener 178, such as a screw or the like, extending through respective tabs extending from opposing edges of the housing cap 160. The fasteners 178 are aligned with and extend into the apertures 154 and 158, securing the spotlight assembly 150 to the lens assembly 106' and the light portion 18'.

Figure 9:
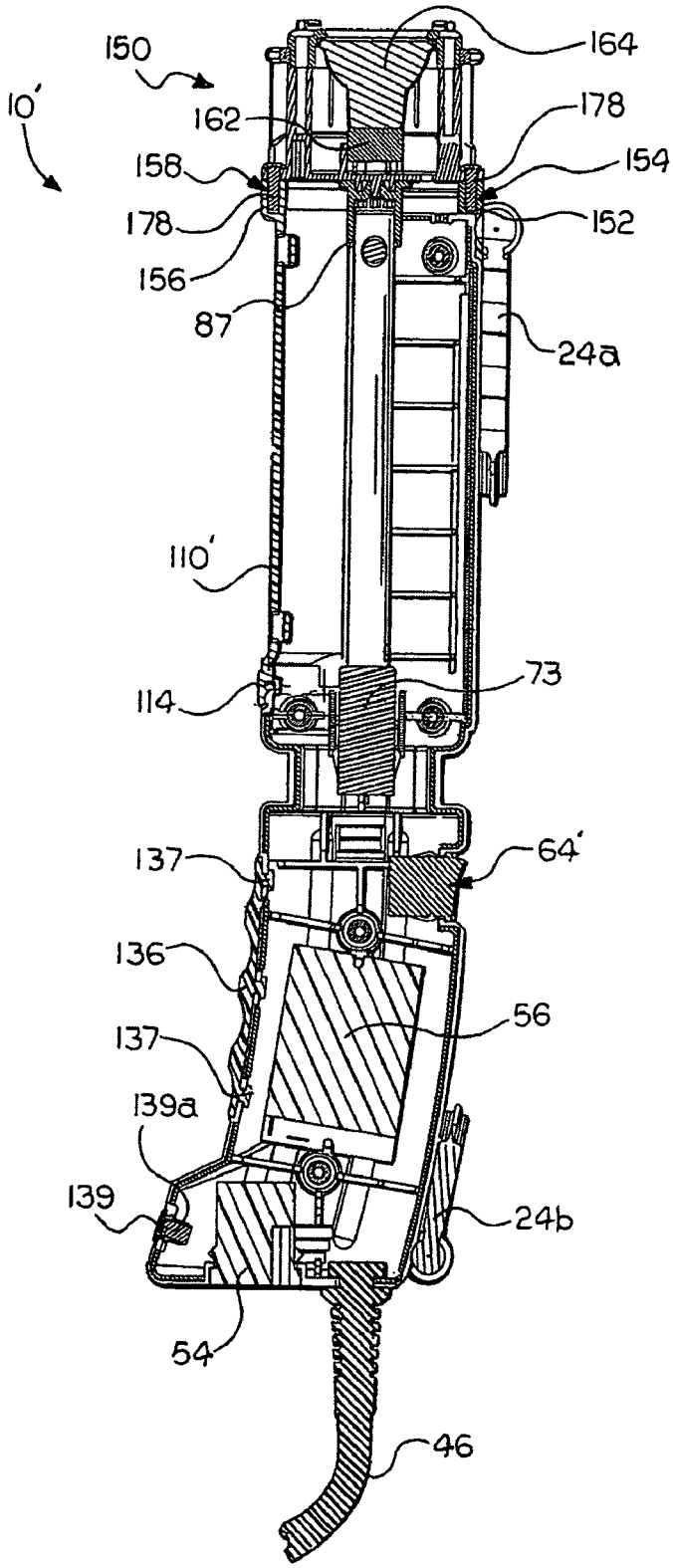
FIG. 9 is a longitudinal cross-sectional view of the utility light shown in FIGS. 6A and 6B.

The utility light 10' includes the elongated handle cushion 136 having a plurality of projections 137, best seen in FIG. 9, that are received the corresponding gaps 138 formed in a front surface of the light housing 12' between the halves 14' and 16' of the handle portion 20'. The handle cushion 136 is preferably constructed of a soft, easily deflectable material. The power indicator LED 139 and the electrical contact 139*a* are received in the aperture 141 formed in the front surface of the light housing 12' between the halves 14' and 16' of the handle portion 20'. The LED 139 is electrically connected to the power cord 42 and emits a light when energized, providing a visual indication of the status of the outlet 54 and the utility light 10' to the user of the light 10'.

The split halves 14' and 16' of the light housing 12' are joined by a plurality of fasteners such as screws (not shown) to complete the assembly of the halves of the housing 12'. The screws are received in apertures 140 formed in the half 14' of the housing 12', and fastened to corresponding tapped cylindrical posts 142 formed in an interior wall in the half 16' of the housing 12'. When the split halves 14' and 16' are joined, a tongue 180 extending from a rear edge of the housing half 14' cooperates with a groove 182 formed between a pair of flanges 184 extending from a rear edge of the housing half 16' best seen in FIG. 8, to provide ease of alignment of the split halves 14' and 16' during assembly of the light housing 12'. After the split halves 14' and 16' of the light housing 12' are joined, the spotlight assembly 150 is attached to the housing 12' with the fasteners 178. After the utility light 10' has been assembled, it is ready for use. The utility light 10' advantageously may be used in the normal manner when the lamp assembly 78 is energized. The utility light 10' advantageously may be used as a spotlight when the spotlight assembly 150 is energized, providing great flexibility to the users of the utility light 10'.

Figure 10:
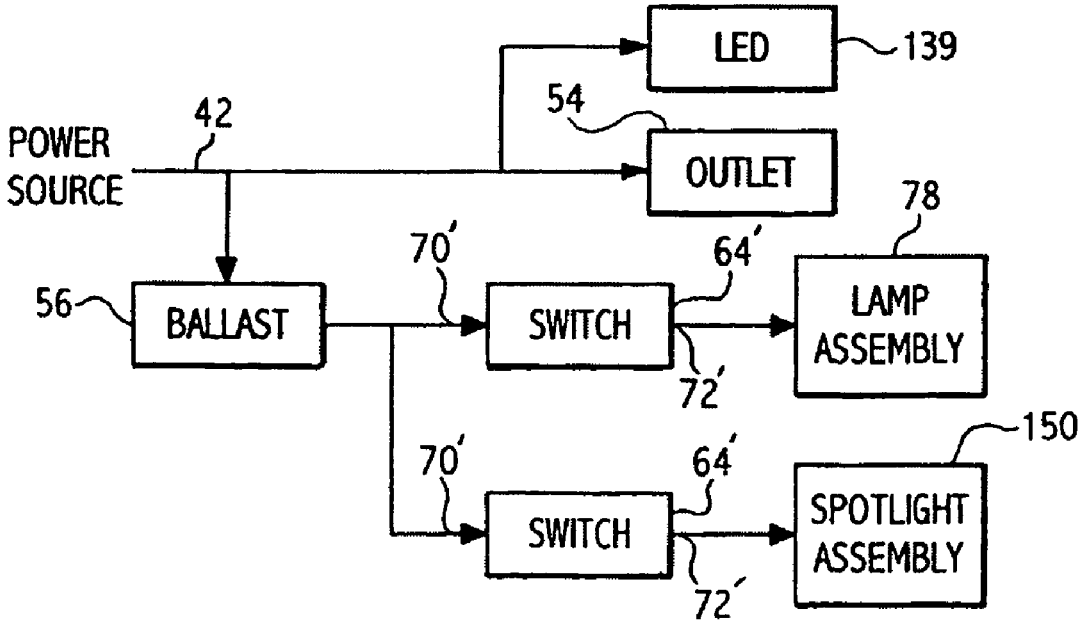
FIG. 10 is an electrical schematic for the utility light components shown in FIG. 7.
Figure 6A:
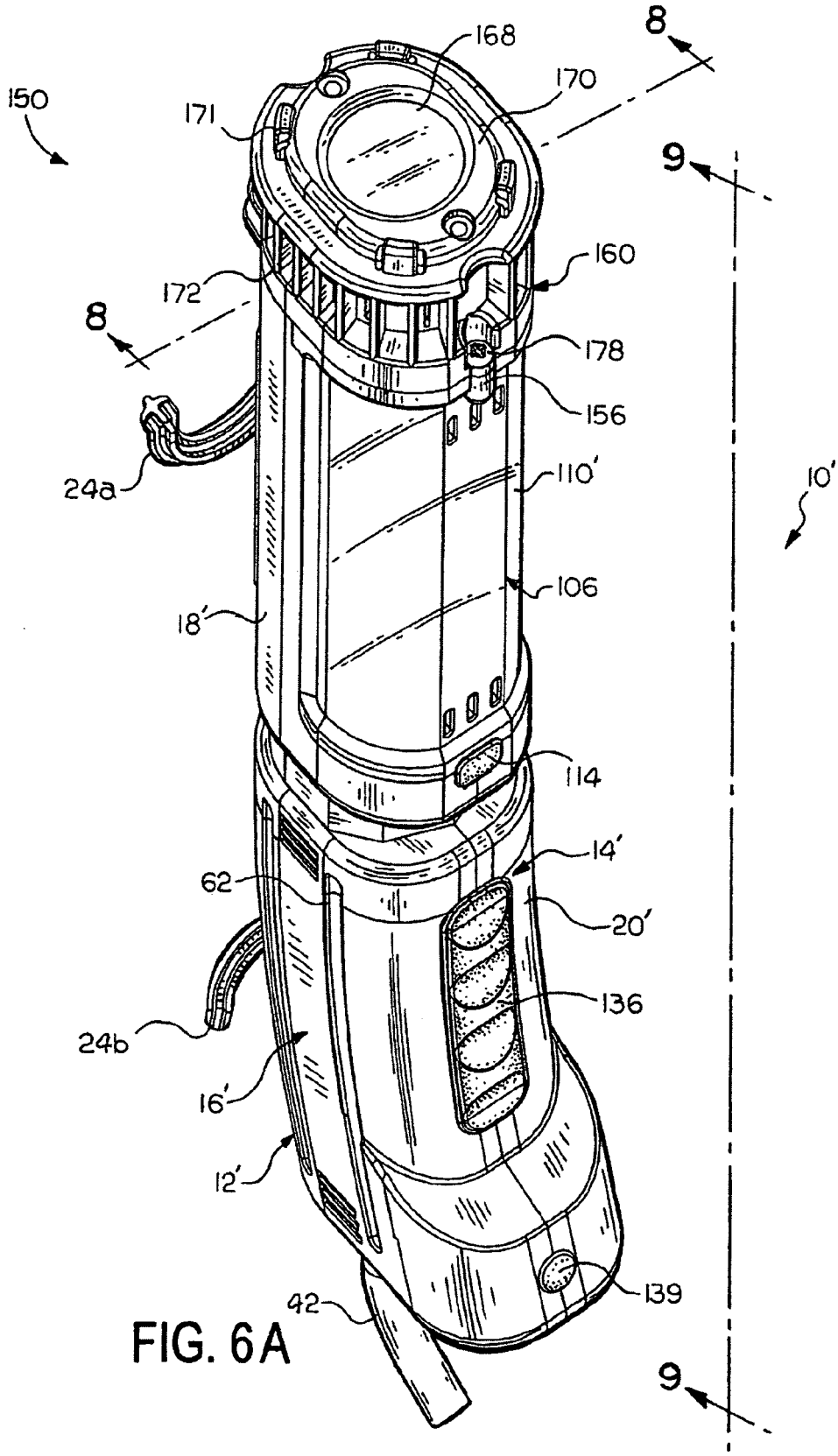
FIGS. 6A and 6B are perspective front and rear views respectively of an alternative embodiment of a fluorescent utility light in accordance with the present invention.
Figure 6B:
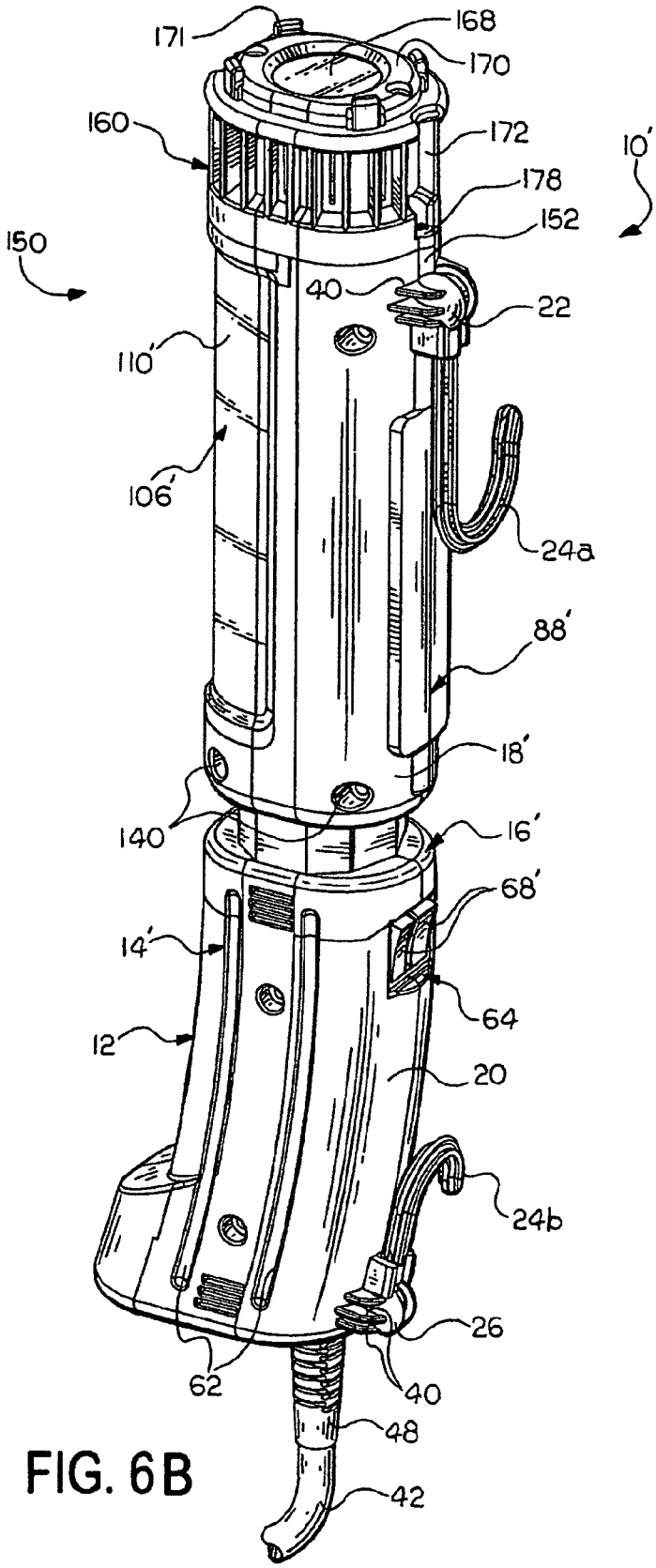
Figure 7:
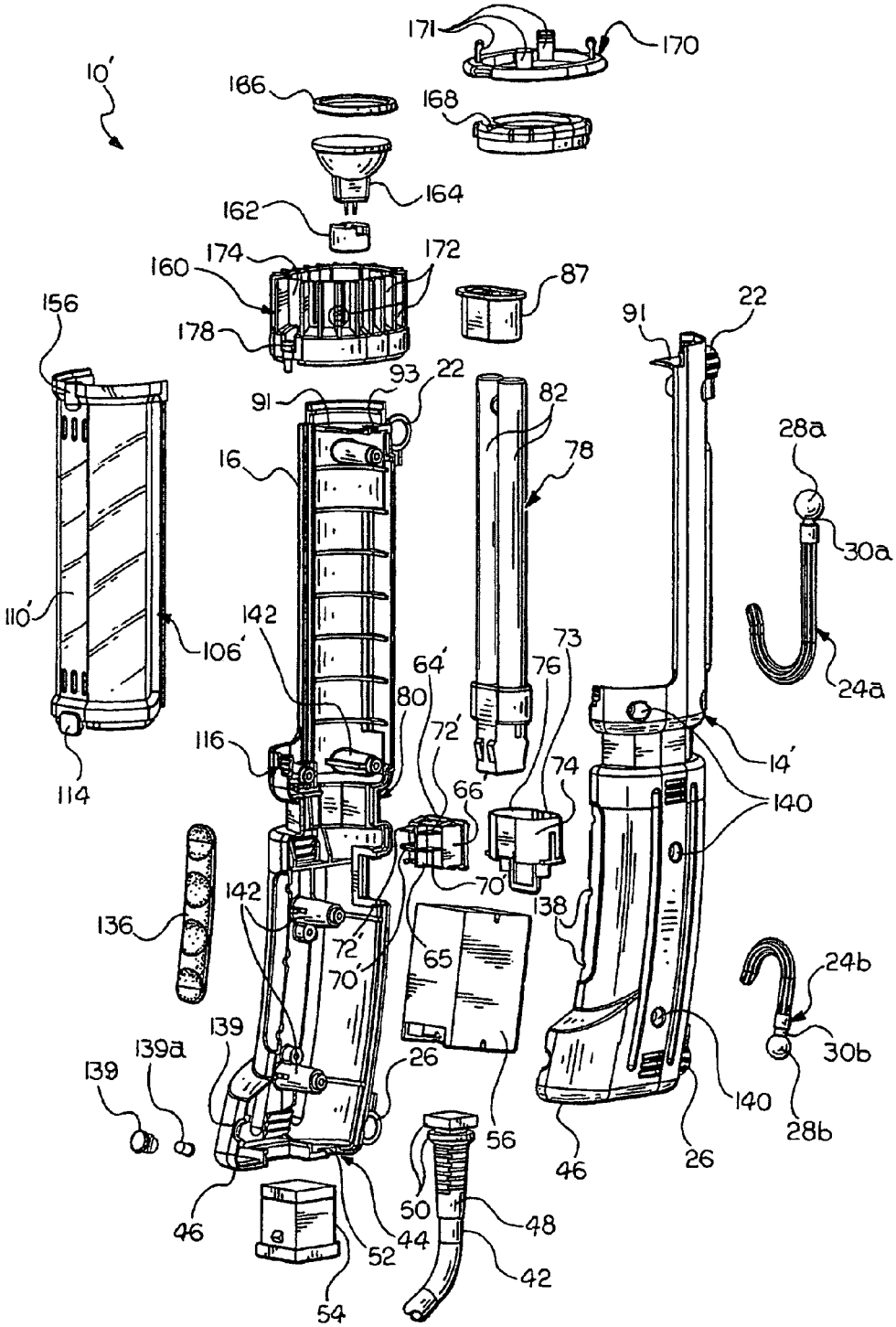
FIG. 7 is an exploded perspective view of the utility light shown in FIGS. 6A and 6B.

An electrical schematic of the utility light 10' is shown in FIG. 10. The cord 42 is provided for connection to an external power source which connection will render the outlet 54 and the LED 139 "live". The electrical power from the cord 42 is directed through the ballast 56 to each of the switch sides 64' which switch sides individually control the lamp assembly 78 and the spotlight assembly 150.

Figure 11:
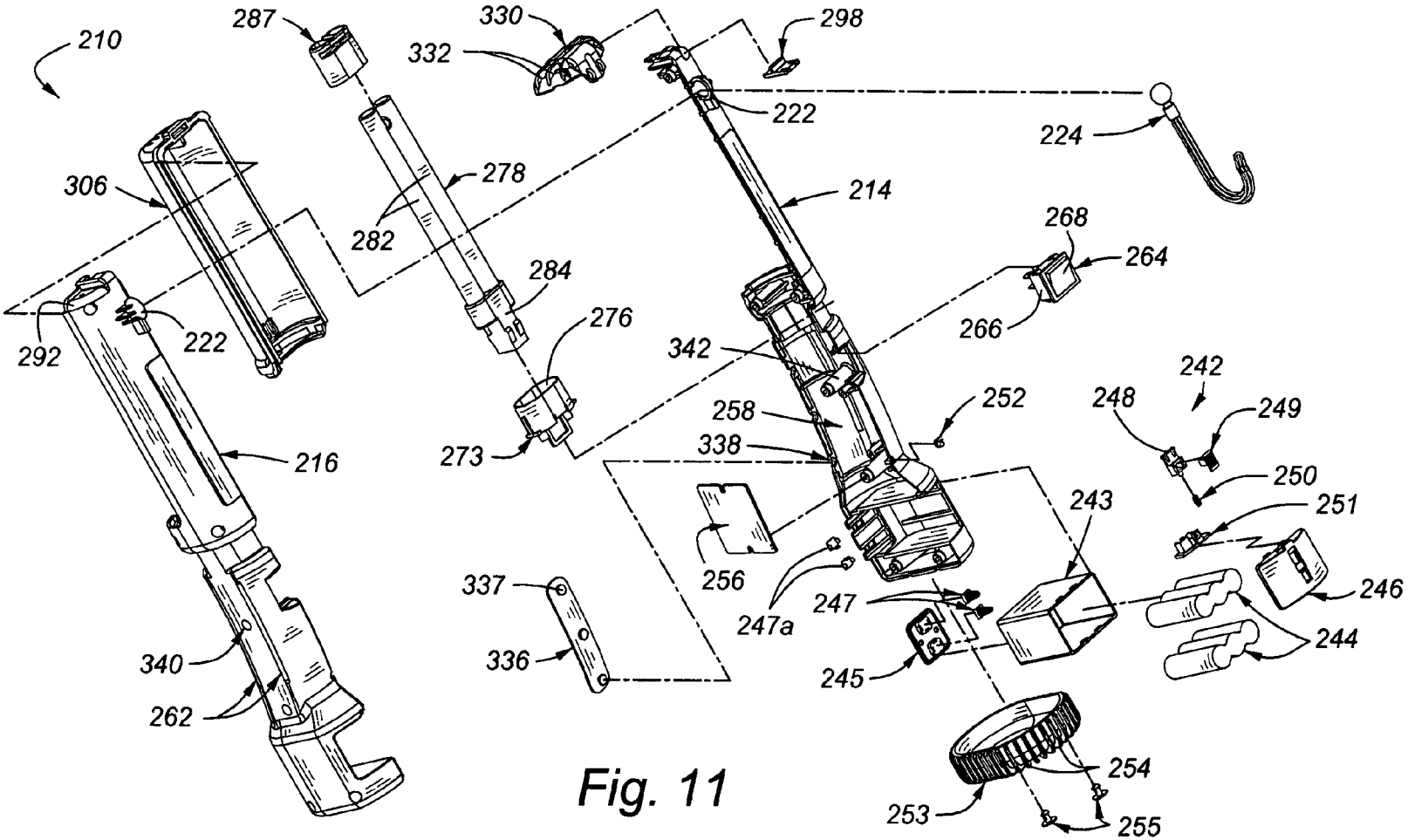
FIG. 11 is an exploded perspective view of another alternative embodiment of a utility light in accordance with the present invention.
Figure 12:
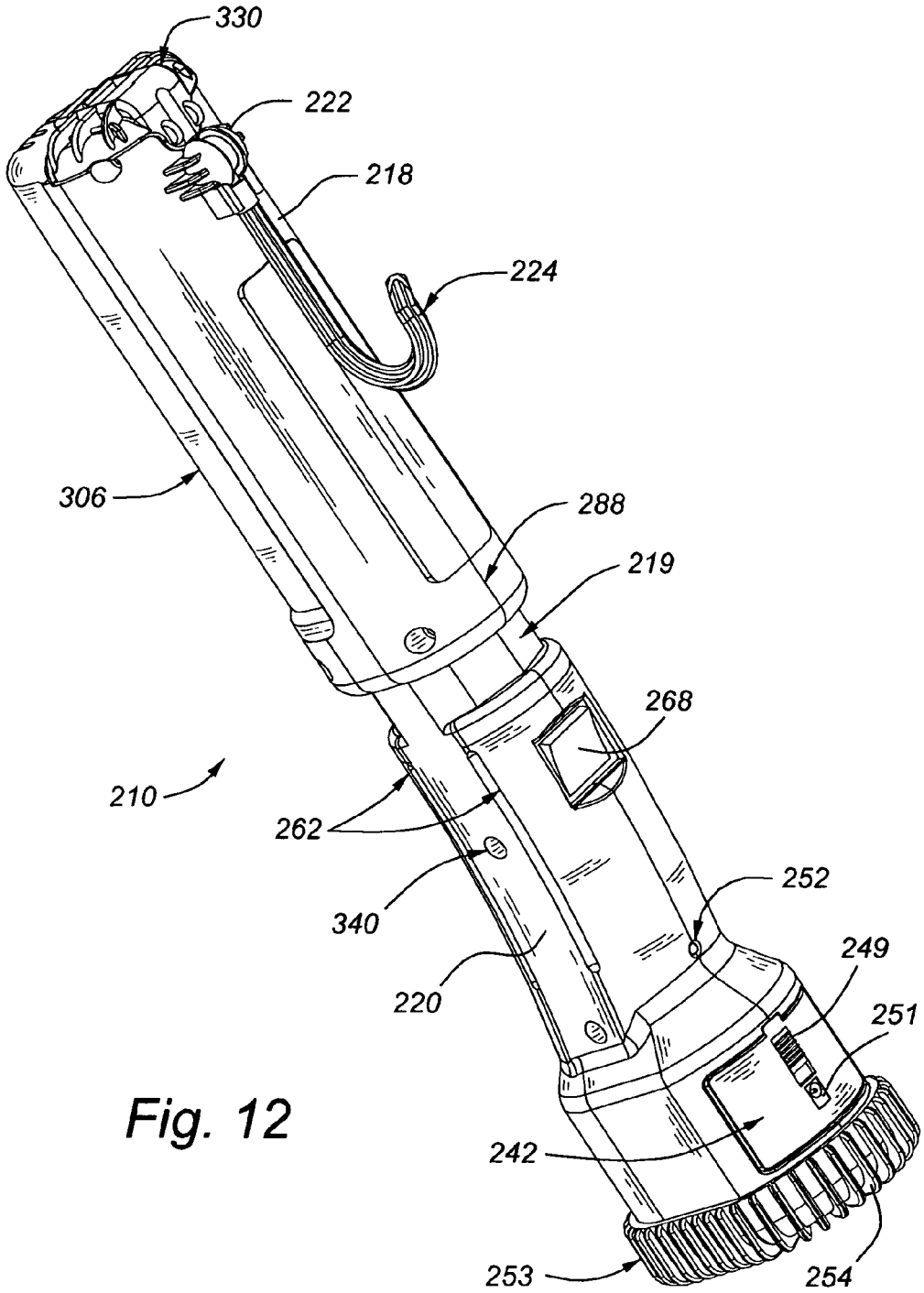
FIG. 12 is a rear perspective view of the utility light shown in FIG. 12.
Figure 13:
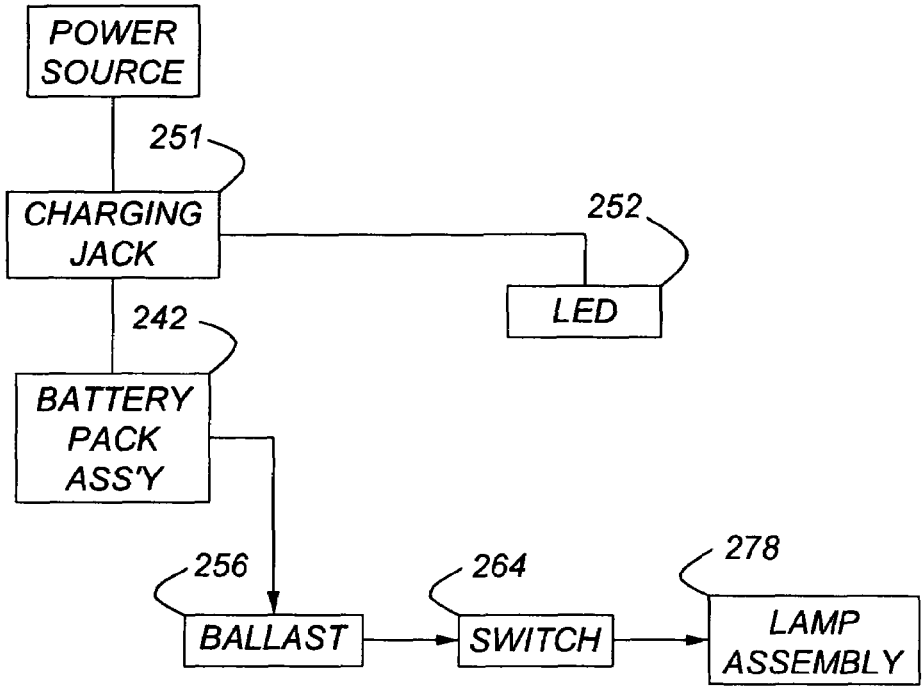
FIG. 13 is an electrical schematic for the utility light components shown in FIG. 11.

Referring now to FIG. 11-13, an alternative embodiment of a rechargeable utility light in accordance with the present invention is indicated generally at 210 and is similar to the utility light 10 shown in FIGS. 1A, 1B, and 2-4. The utility light 210 includes a vertically split hollow light housing 212 formed in two housing halves 214 and 216 with an elongated upper light portion 218 extending from a hollow lower handle portion 220. The handle portion 220 is preferably ergonomically curved to allow the utility light 210 to be easily manipulated during use. The housing 212 is preferably formed of a lightweight material, such as plastic, as the utility light 210 is contemplated to be both handheld and portable.

Each half 214 and 216 of the split housing 212 includes an outwardly extending half upper socket 222 for receiving an upper hook 224. The upper hook 224 includes a ball portion 228 that is connected to a shank portion 230. The ball portion 228 is retained between the halves of the respective sockets 222, forming a ball and socket connection. When the halves 214 and 216 of the split housing 212 are joined, recesses formed in facing surfaces of the halves of the sockets 222 receive the ball portion 228. The facing surfaces of the halves of the sockets 222 are similar in construction to the sockets 22 shown in FIG. 1B and allow the hook 224 pivot and rotate in a manner similar to that shown with the hooks 24*a* and 24*b* in FIG. 1B.

A battery pack assembly 242 is releasably disposed in an aperture formed between the halves of the handle portion 220. The battery pack assembly 242 includes a housing 243 for receiving at least one battery cell 244, a rear cover 245, and a front cover 246. The rear cover 245 is attached to the rear of the housing 243 and includes electrical contacts that are electrically connected to the battery cells 244. Contact springs 247 and associated bases 247*a* are mounted in the handle portion 220 and make electrical contact with the battery cells 244 through the rear cover 245. The bases 247*a* are further electrically connected to the electrical circuitry enclosed within the handle portion 220, discussed in more detail below. The front cover 246 is releasably attached to the housing 243 (tab and slot) and includes a locking slide assembly 248 engaged with a slide tab 249 and a spring 250 that biases the assembly 248 and the tab 249 upwardly.

When installed in the recess of the handle portion 220, the rear cover 245 engages with and compresses the contact springs 247. In a locked first position, the spring 250 biases the locking slide assembly 249 to mechanically engage with a lip (not shown) or the like of the handle portion 220 to retain the battery pack assembly 242 in the recess of the handle portion 220. When the tab 249 is moved downwardly to an unlocked second position, the assembly 248 compresses the spring 250 and disengages with the lip of the handle portion 220 to allow the contact springs 247 to extend the battery pack assembly 242 from the recess of the handle portion 220 and permit the battery pack assembly 242 to be removed.

The front cover 246 also includes a charging jack 251 is operable to engage with a connector (not shown) of an electrical cord (not shown) extending from, for example, an AC to DC transformer (not shown) connected with an AC power source for charging the battery cells 244 of the battery pack assembly 242 while the assembly 242 is installed in the handle portion 220. An LED indicator 252 is electrically connected to the charging jack 251 and emits a light when energized, providing a visual indication of the charging status of the battery cells 244 of the battery pack assembly 242 to the user of the utility light 210.

A circuit board assembly 256 is received in an interior recess 258 in the hollow handle portion 220. The circuit board assembly 256 includes a ballast for the utility light 210. A plurality of slots 262 are formed in a side wall of each half of the handle portion 220 to provide air circulation and remove heat generated by the circuit board assembly 256. The circuit board assembly 256 provides power to the remainder of the electrical circuitry enclosed within the handle portion 220.

A single switch 264 includes a switch housing 266 with a switch rocker 268 having electrical terminals that are electrically connected to the circuit board assembly 256 and to an electrical terminal of a lamp socket 273. The switch 264 is easily actuated by a thumb or finger of a person (not shown)

holding the handle portion 220 to light a lamp assembly 278 with one hand while also orienting and/or hanging the light 210 with the same hand.

The lamp socket 273 is preferably a commercially available socket and includes a socket housing 274 having a socket 276 formed therein for receiving the fluorescent lamp assembly 278. The electrical terminals that extend downwardly from a bottom surface of the socket housing 274 from the socket 276 are electrically connected to the electrical terminals of the switch 264, forming an electrical circuit. The socket housing 274 is received in a cavity at an upper end of the handle portion 220.

The socket 276 receives the lamp assembly 278 that includes twin fluorescent bulbs 282 that are mounted in a base 284 having a plurality of electrical contacts that cooperate with interior electrical contacts (not shown) in the socket 276. The base 284 includes internal electrical contacts (not shown) for the bulbs 282. If a bulb 282 fails, the lamp assembly 278 is replaced as an assembly; the individual bulbs 282 are not replaced. Alternatively, the bulbs 282 may be single bulbs that may be replaced individually. When the switch 264 is activated, power is sent to the socket 276 and thus to the lamp assembly 278, the lamp assembly 278, the socket 273, and the switch 264 forming a separate electrical circuit. A reflector (not shown) for directing the illumination towards a work area (not shown) and away from the light portion 218 may be attached on a posterior side of the lamp assembly 278, and cooperates with notches (not shown) on an interior surface of the light portion 218. A bulb cushion 287 includes apertures (not shown) formed therein to receive respective free upper ends of the fluorescent bulbs 282 for protecting the bulbs 282 from breakage during use of the utility light 210. The bulb cushion 287 is preferably constructed of a deformable, resilient shock absorbing material.

The upper light portion 218 of the light housing 212 is generally oval in cross-section and the halves of the upper light portion 218 are joined at a seam 288 (FIG. 13) on the rear surface of the housing 212 in a manner similar to the light portion 18 shown in FIGS. 1A-4 and include a locking tab 298, similar in construction to the locking tab 98 of FIGS. 1A-4, for removing and installing a lens assembly 306, similar in construction to the lens assembly 106. The lens assembly 306 is attached to the light portion 218 in a manner similar to the light assembly 106 and the light portion 18 shown in FIGS. 1A-4.

A housing cushion 330 is received by the top surface 292 of the assembled light portion 216. The housing cushion 330 includes a plurality of external fins 332 and absorbs shock forces encountered during use of the utility lamp 210. The housing cushion 330 is preferably press fit over the top portion 292. Alternatively, the housing cushion 330 is attached to the top portion 292 by fasteners or the like. The housing cushion 330 is preferably constructed of a deformable, resilient shock absorbing material.

An elongated handle cushion 336 includes a plurality of projections 337 that are received in corresponding gaps 338 formed in a front surface of the light housing 212 between the halves 214 and 216 of the handle portion 220. The handle cushion 336 is preferably constructed of a soft, easily deflectable material. A bottom cushion 253 is adapted to be attached to a lower surface of the assembled handle portion 220, such as by a plurality of fasteners 255 or the like. The bottom cushion 253 includes a plurality of external fins 254 and absorbs shock forces encountered during use of the utility lamp 210 and is preferably constructed of a deformable, resilient shock absorbing material.

A charging stand (not shown), such as that shown in FIG. 6 of commonly owned and co-pending U.S. patent application Ser. No. 11/200,568 (incorporated herein by reference), may be provided with the utility light 210 for charging the removable battery pack assembly 242. In this case, the charging jack 251 and the LED 252 are not required. The charging stand is preferably adapted to be plugged into a common wall receptacle and defines a recess therein for receiving the removable battery pack assembly 242. Complementary charging contacts would be provided on the charging stand and the battery pack assembly 242. Advantageously, two or more of the battery pack assemblies 242 may be provided with the utility light 210, which would enable continued use of the utility light 210 while one of the battery pack assemblies 242 is being charged in the charging stand.

Figure 4:
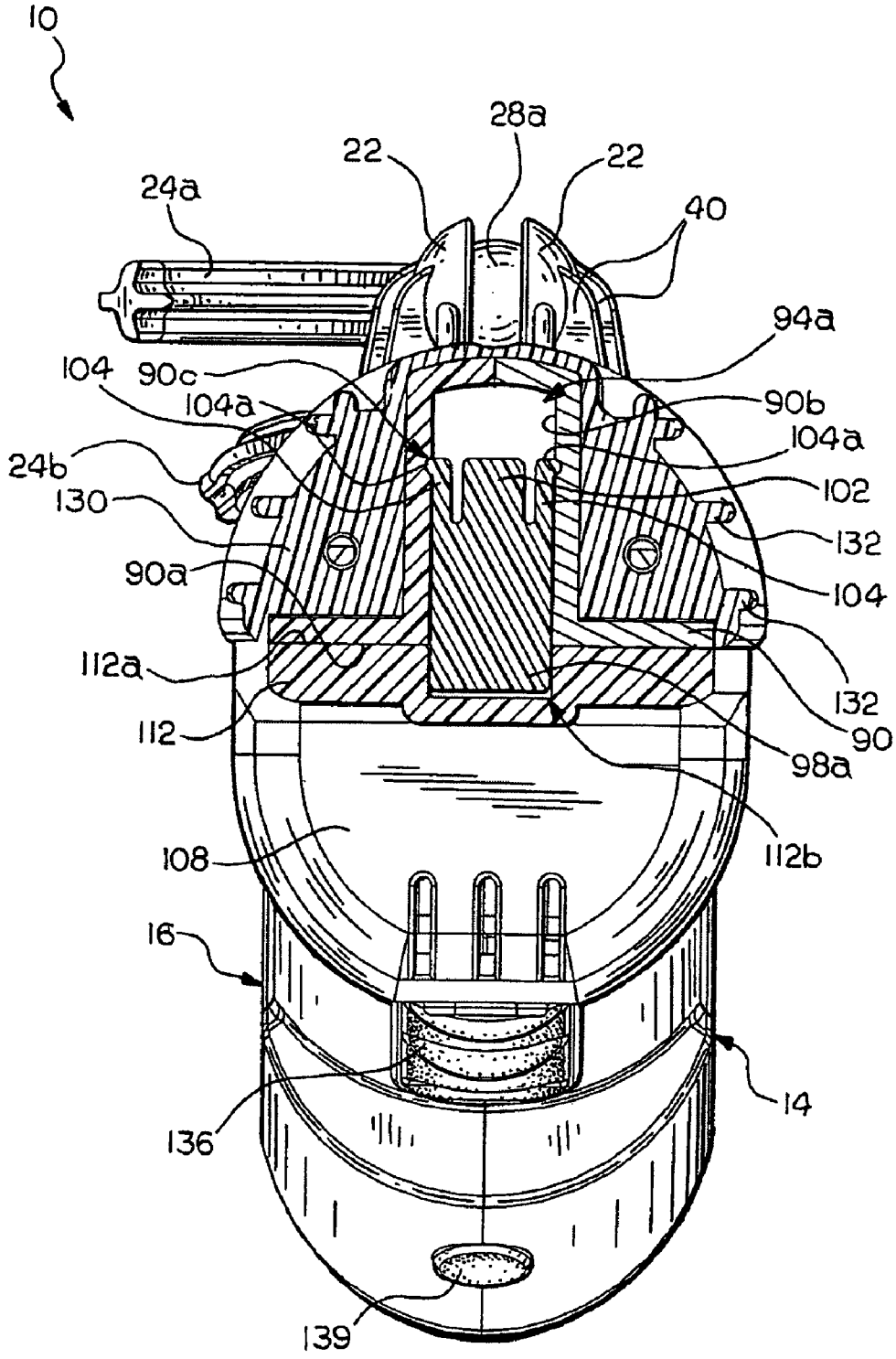
FIG. 4 is a top plan view in partial cross section of the utility light shown in FIGS. 1A and 1B.

A magnet or magnet assembly (not shown), such as that shown in FIGS. 1, 3 and 4 of U.S. Pat. No. 5,921,658 (incorporated herein by reference), can be adapted to be attached to an intermediate portion 219 of the utility light 210 between the handle portion 220 and the light portion 218.

The split halves 214 and 216 of the light housing 212 are joined by a plurality of fasteners such as screws (not shown) to complete the assembly of the halves of the housing 212 along the seam 289. The screws are received in apertures 340 formed in the half 216 of the housing 212, and fastened to corresponding tapped cylindrical posts 342 formed in an interior wall in the half 214 of the housing 212.

After the utility light 210 has been assembled with the screws, it is ready for use. The lamp assembly 278 is replaced in a manner similar to the lamp assembly 78, by moving the locking tab 298 from a locked to an unlocked position, detaching the lens assembly 306 from the light portion 218, and removing the lamb assembly 278 from the socket 273. The lens assembly 306 may be detached by sliding the lens assembly 306 upwardly along the interlocking flanges (similar to the interlocking flanges 118*a*, 118*b*, 122*a*, and 122*b* shown in FIG. 3) and away from the lens opening or by contacting opposed sides of the lens assembly 306 with a thumb and finger and flexing inwardly to disengage the interlocking flanges and enabling one to pull the lens assembly 306 away from the lens opening in the light portion 218.

An electrical schematic of the utility light 210 is shown in FIG. 13. The charging jack 251 is operable to be connected to an external power source for charging the power battery cells 244 of the battery pack assembly 242. The external power source can generate DC power of the correct voltage to charge the battery cells 244, or the charging jack 251 can include circuitry for converting the input power to charging power. When connected to the electrical power source, the charging jack 251 renders the LED 252 "live". The electrical power from the battery pack assembly 242 is directed through the ballast 256 to the switch 264, which controls the turning "on" and "off" of the lamp assembly 278.

Figure 14:
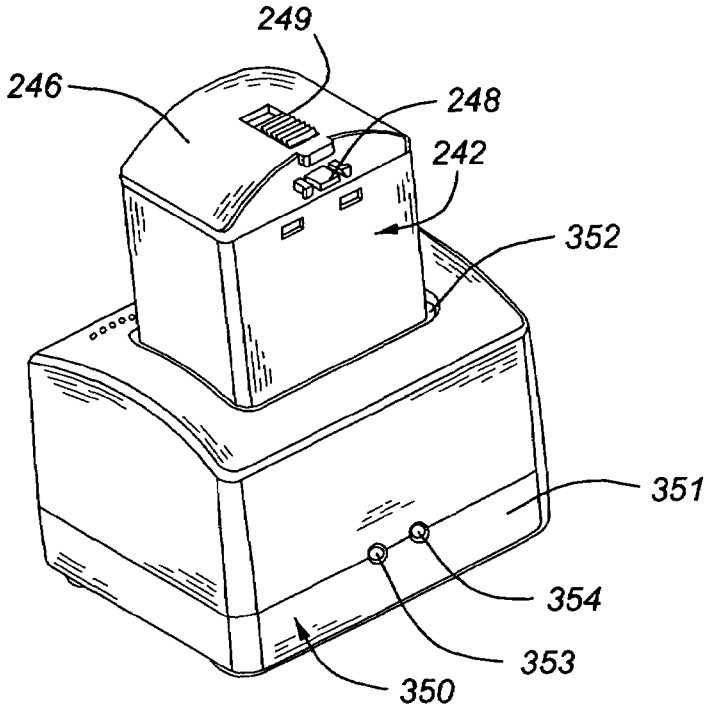
FIG. 14 is a perspective view of the battery pack assembly shown in FIG. 11 received in a charging stand according to the present invention.

In FIG. 14, there is shown the battery pack assembly 242 received in a charging stand 350. A body 351 of the stand 350 has a recess or cavity 352 formed in an upper surface for releasably receiving and retaining the battery pack assembly 242 with the rear cover 245 (not shown) facing downwardly. The body encloses known circuitry for converting AC input power into the correct voltage DC power for charging the battery pack assembly 242. A pair of indicator lights 353, 354 is provided on a front surface of the body 351. The lights can be LED indicators wherein, for example, the light 353 indicating connection to the AC input power and the light 354 indicating charging status (steady for charging and blinking for full charge). Other function indications are possible such as the light 353 indicating charging and the light 354 indicating full charge.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A rechargeable fluorescent utility light comprising:

a light housing having an upper light portion and a lower handle portion, said light portion having a lens opening and said handle portion being sized for gripping by a human hand;

a lens assembly closing said lens opening and being releasably attached to said light housing;

a fluorescent lamp assembly mounted in said light portion adjacent said lens assembly for generating light through said lens assembly;

a battery pack assembly releasably mounted in said handle portion;

a ballast mounted in said light housing for converting DC power to AC power; and a switch means connected in series with said ballast between said battery pack assembly and said fluorescent lamp assembly for selectively connecting said battery pack assembly to said fluorescent lamp assembly to generate the light.

2. The utility light according to claim 1 wherein said light housing is shaped to stand upright when a lower end of said handle portion is placed on a supporting surface.

3. The utility light according to claim 1 including at least one of a housing cushion attached at an upper end of said light portion and a bottom cushion attached at a lower end of said handle portion.

4. The utility light according to claim 1 including a handle cushion attached to said handle portion.

5. The utility light according to claim 1 wherein said battery pack assembly includes locking means engaging said handle portion and preventing removal of said battery pack assembly from said handle portion.

6. The utility light according to claim 5 wherein said locking means includes a locking slide assembly spring biased into engagement with said handle portion and connected to an exposed slide tab moveable between a locked position and an unlocked position whereby when said slide tab is moved to said unlocked position, said locking slide assembly is disengaged from said handle portion to permit removal of said battery pack assembly from said handle portion.

7. The utility light according to claim 1 including at least one contact spring mounted in said handle portion for biasing said battery pack assembly to extend from said handle portion.

8. The utility light according to claim 1 wherein said battery pack assembly includes a housing retaining at least one battery cell and a front cover releasably attached to said housing for removing said at least one battery cell.

9. The utility light according to claim 1 wherein said battery pack assembly includes a housing retaining at least one battery cell and a rear cover attached to said housing for electrically connecting said at least one battery cell to said switch means, and including a charging stand for electrically connecting said at least one battery cell to a source of charging power when said battery pack assembly is removed from said handle portion and is inserted into said charging stand.

10. The utility light according to claim 1 wherein said light portion has a swivel hook mounted thereon.

11. A rechargeable fluorescent utility light comprising:

a light housing having an upper light portion and a lower handle portion, said light portion having a lens opening and said handle portion being sized for gripping by a human hand, said light housing being shaped to stand upright when a lower end of said handle portion is placed on a supporting surface;

a lens assembly closing said lens opening and being releasably attached to said light housing;

a fluorescent lamp assembly mounted in said light portion adjacent said lens assembly for generating light through said lens assembly;

a battery pack assembly releasably mounted in said handle portion including a housing retaining at least one battery cell, a front cover releasably attached to said housing for removing said at least one battery cell, and a rear cover attached to said housing for electrically connecting said at least one battery cell to said fluorescent lamp assembly;

a ballast mounted in said light housing for converting DC power to AC power; and a switch means connected in series with said ballast between said battery pack assembly and said fluorescent lamp assembly for selectively connecting said battery pack assembly to said fluorescent lamp assembly to generate the light.

12. The utility light according to claim 11 including at least one of a housing cushion attached at an upper end of said light portion and a bottom cushion attached at said lower end of said handle portion.

13. The utility light according to claim 11 including a handle cushion attached to said handle portion.

14. The utility light according to claim 11 wherein said battery pack assembly includes locking means engaging said handle portion and preventing removal of said battery pack assembly from said handle portion.

15. The utility light according to claim 14 wherein said locking means includes a locking slide assembly spring biased into engagement with said handle portion and connected to a slide tab exposed at said front cover and moveable between a locked position and an unlocked position whereby when said slide tab is moved to said unlocked position, said locking slide assembly is disengaged from said handle portion to permit removal of said battery pack assembly from said handle portion.

16. The utility light according to claim 11 including at least one contact spring mounted in said handle portion for biasing said battery pack assembly to extend from said handle portion.

17. The utility light according to claim 11 wherein said light portion has a swivel hook mounted thereon.

18. A rechargeable fluorescent utility light comprising:

a light housing having an upper light portion and a lower handle portion, said light portion having a lens opening and said handle portion being sized for gripping by a human hand;

a lens assembly closing said lens opening and being releasably attached to said light housing;

a fluorescent lamp assembly mounted in said light portion adjacent said lens assembly for generating light through said lens assembly;

a battery pack assembly releasably mounted in said handle portion including a housing retaining at least one battery cell and a front cover releasably attached to said housing for removing said at least one battery cell;

at least one contact spring mounted in said handle portion for biasing said battery pack assembly to extend from said handle portion;

a ballast mounted in said light housing for converting DC power into AC power; and a switch means connected in series with said ballast between said battery pack assembly and said fluorescent lamp assembly for selectively connecting said battery pack assembly to said fluorescent lamp assembly to generate the light.

19. The utility light according to claim 18 wherein said battery pack assembly includes locking means engaging said handle portion in a locked position to maintain said at least one spring contact in a compressed state and preventing removal of said battery pack assembly from said handle portion.

20. The utility light according to claim 18 including a bottom cushion attached at a lower end of said handle portion.

* * * * *